US006997243B2

(12) United States Patent
Hsu

(10) Patent No.: US 6,997,243 B2
(45) Date of Patent: Feb. 14, 2006

(54) WICK STRUCTURE OF HEAT PIPE

(76) Inventor: Hul-Chun Hsu, 6F-3, No. 422, Sec. 2, Li-Ming Rd., Taichung (TW)

( * ) Notice: Subject to any disclaimer, the term of this patent is extended or adjusted under 35 U.S.C. 154(b) by 0 days.

(21) Appl. No.: 10/829,975

(22) Filed: Apr. 23, 2004

(65) Prior Publication Data

US 2005/0247436 A1 Nov. 10, 2005

(51) Int. Cl.
*F28D 15/00* (2006.01)

(52) U.S. Cl. ..... 165/104.26; 165/104.33; 361/700; 361/704; 257/714; 174/15.2

(58) Field of Classification Search ..... 165/104.26, 165/104.33, 104.21, 185, 80.4; 361/699, 361/700; 174/15.2; 257/714–716
See application file for complete search history.

(56) References Cited

U.S. PATENT DOCUMENTS 4,274,479 A * 6/1981 Eastman ..... 165/104.26
5,412,535 A * 5/1995 Chao et al. ..... 361/700
5,632,158 A * 5/1997 Tajima ..... 62/259.2
6,082,443 A * 7/2000 Yamamoto et al. .... 165/104.26
6,648,063 B1 * 11/2003 Andraka et al. ..... 165/104.26
6,725,909 B1 * 4/2004 Luo ..... 165/104.21
6,738,257 B1 * 5/2004 Lai ..... 361/700
6,793,009 B1 * 9/2004 Sarraf ..... 165/104.33

* cited by examiner

*Primary Examiner*—Terrell L. McKinnon

(57) ABSTRACT

A composite wick structure of a heat pipe includes wick structure fabricated from a woven mesh and sintered powder. The woven mesh is attached to an internal sidewall of a tubular member, while the sintered powder is coated on at least one side of the internal sidewall. By the better capillary force provided by the sintered powder, the liquid-phase working fluid can reflow to the bottom of the heat pipe quickly to enhance the heat transmission efficiency. Further, the problems of poor capillary effect of the woven mesh and the problems caused by usage of an axial rod during the process of applying sintered powder can be resolved.

7 Claims, 3 Drawing Sheets

WICK STRUCTURE OF HEAT PIPE

BACKGROUND OF THE INVENTION

The present invention relates in general to a composite wick structure of a heat pipe, and more particularly, to a wick structure fabricated from a woven mesh and a sintered powder.

Having the features of high heat transmission capability, high-speed heat conductance, high thermal conductivity, light weight, mobile-elements free, simple structure, the versatile application, and low power for heat transmission, heat pipes have been popularly applied in heat dissipation devices in the industry. The conventional heat pipe includes a wick structure on an internal sidewall of a tubular member. The wick structure typically includes a woven mesh or sintered powder to aid in transmission of working fluid.

However, the woven mesh or the sintered powder each has advantages and drawbacks.

For example, the fine and dense structure of the sintered-powder wick structure provides better capillary force for reflow of the liquid-state working fluid. However, during fabrication, an axial rod has to be inserted into the tubular member to serve as a support member of the wick structure during the sintering process, so as to avoid collapse of the powdered which has not been sintered yet. Therefore, the thickness of the sintered powder wick structure is thicker. Consequently, the capillary thermal resistance is increased to be disadvantageous to the heat transmission. Further, requirement of the axial rod hinders the mass production of the heat pipe and causes fabrication and quality issues of the heat pipe.

The woven mesh wick structure does not require the axial rod, such that the problems of the sintered powder wick structure do not encounter. Further, the woven mesh wick structure is more easily to fabricate compared to the sintered-powder wick structure. However, as the woven mesh is made by weaving metal wires, the porosities are larger to provide a poor capillary effect. The working fluid is less easily to reflow, and the thermal conduction efficiency is affected.

Thus, there still is a need in the art to address the aforementioned deficiencies and inadequacies.

BRIEF SUMMARY OF THE INVENTION

The present invention provides a composite wick structure of a heat pipe. The composite structure adapts the advantages of both the woven-mesh and the sintered-powder wick structure, such that the transmission capability of the wick structure is maintained, and the heat conduction performance of the heat pipe is improved, while the problems with the caused by the axial rod are resolved.

The composite wick structure provided by the present invention includes a woven mesh and a sintered-powder structure. The woven mesh is attached to an internal sidewall of the heat pipe, while the sintered-powder structure is attached to at least one side of the internal sidewall. By the strong capillary force provided by the sintered-powder structure, the working fluid at the liquid phase easily reflows back to the bottom of the heat pipe, such that the heat transmission efficiency is greatly enhanced.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These as well as other features of the present invention will become more apparent upon reference to the drawings therein.

DETAILED DESCRIPTION OF THE INVENTION

Figure 1:
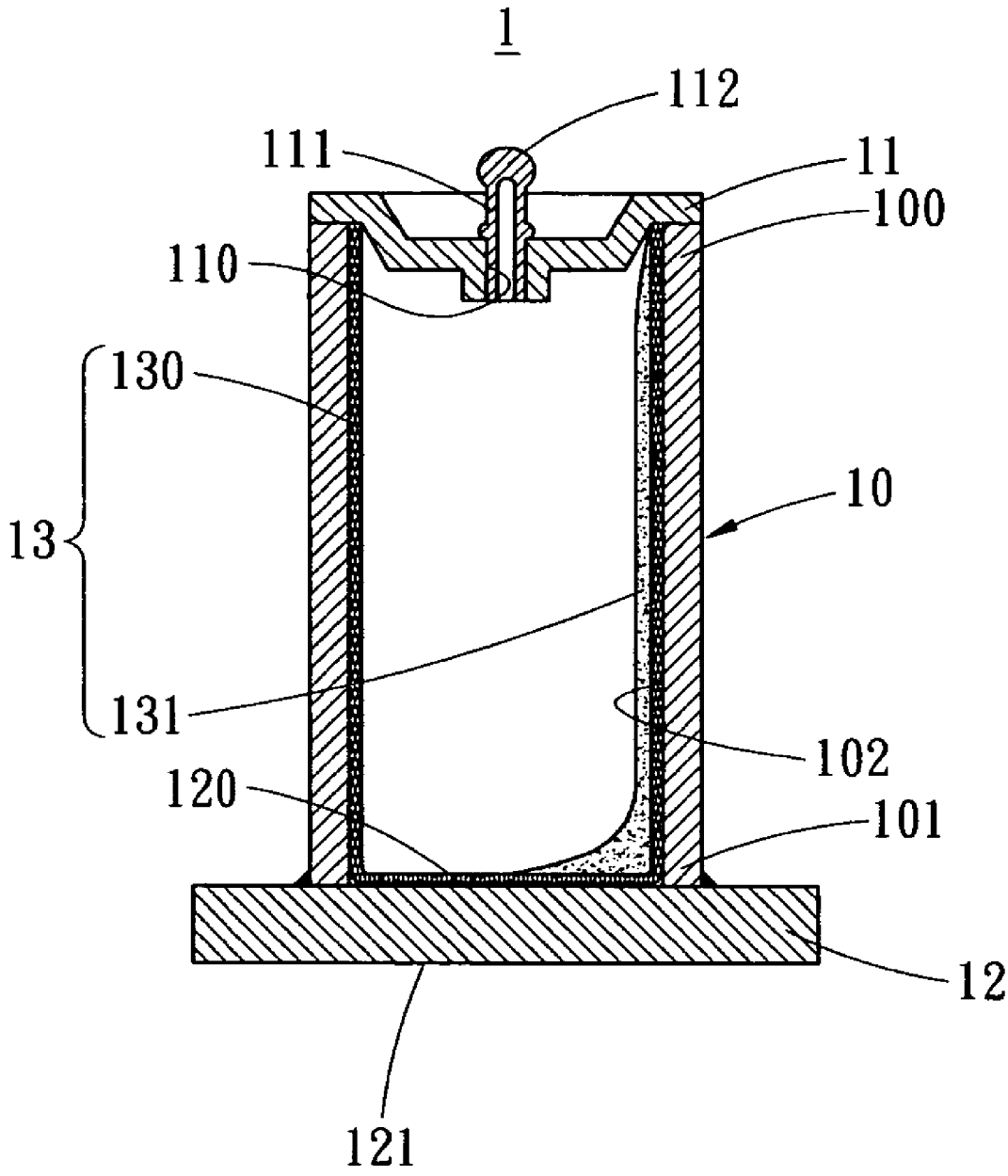
FIG. 1 shows a cross sectional view of a heat pipe in one embodiment of the present invention.

Reference will now be made in detail to the preferred embodiments of the present invention, examples of which are illustrated in the accompanying drawings. Wherever possible, the same reference numbers are used in the drawings and the description to refer to the same or like parts.

Referring now to the drawings wherein the showings are for purpose of illustrating preferred embodiments of the present invention only, and not for purposes of limiting the same, FIG. 1 illustrates a cross sectional view of a heat pipe 1 which comprises a tubular member 10, a top lid 11 and a bottom lid 12.

The tubular member 10 is preferably in the form of a cylindrical hollow tube having two open ends 100 and 101. The open end 100 is covered with the top lid 11, while the other open end 101 is covered with the bottom lid 12. Thereby, the tubular member 10 can be closed and sealed. The tubular member 10 includes an internal sidewall 102, and the top lid 12 has a hole 110 extending therethrough allowing a filling pipe 111 to extend into the tubular member 10 for filling an adequate amount of working fluid inside the tubular member 10. By subsequent process such as vacuuming, the tubular member 10 is sealed by tin wetting or spot welding to form a sealed portion 112. The bottom lid 12 can be formed integrally with the tubular member 10 or mounted to the open end 101 by fusion or other techniques. The bottom lid 12 has an internal surface 120 and an external surface 121. The external surface 121 is preferably a planar surface to be in contact with a heat source. Therefore, the bottom lid 12 serves as a absorbing surface of the heat pipe 1.

Figure 2:
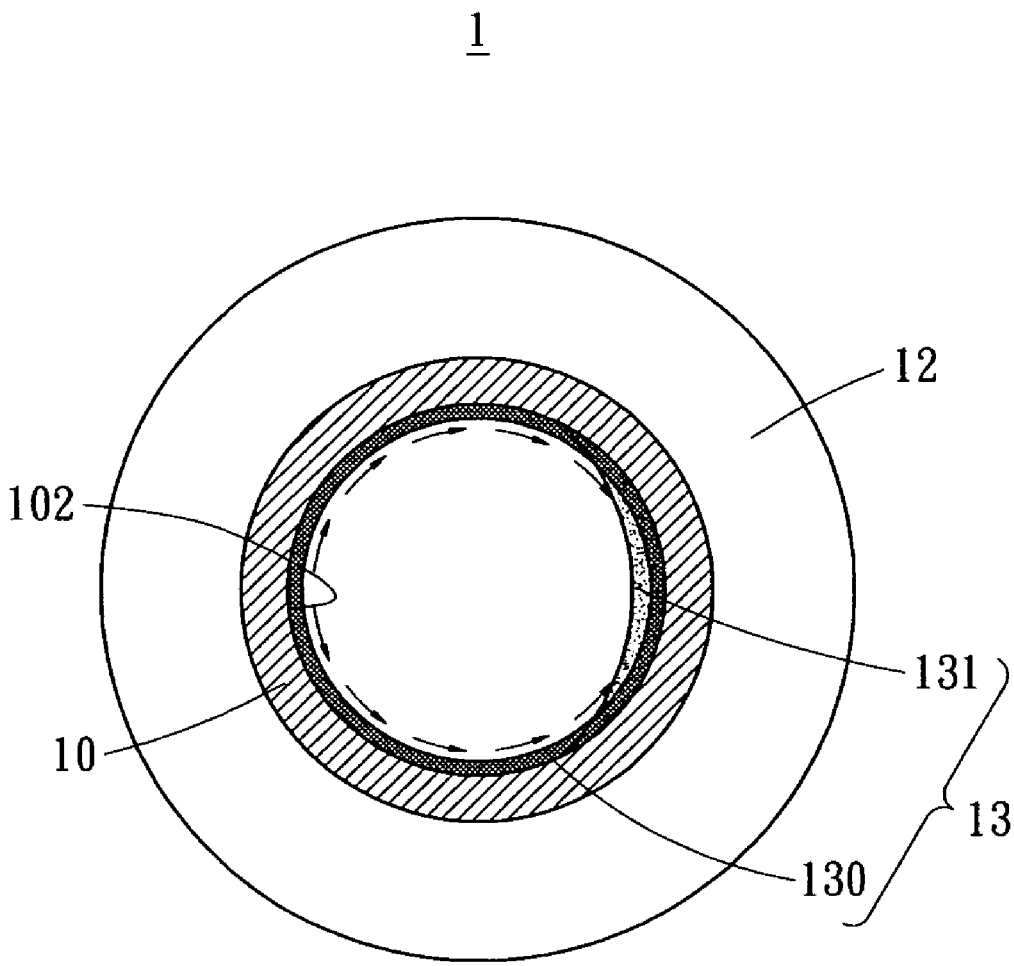
FIG. 2 shows an end surface of the heat pipe.

FIG. 2 shows a cross sectional view of the heat pipe 1. As shown, a wick structure 13 is attached to the internal sidewall 102 of the tubular member 10. The wick structure 13 includes a woven mesh 130 extending all over the sidewall 102 and a sintered-powder structure 131 formed on at least a portion of the woven mesh 130. The sintered-powder structure 131 extends an elongate direction of the tubular member 10. As the sintered-powder structure 131 does not have to cover the whole area of the woven mesh 130, that is, the internal sidewall 102 of the tubular member 10, the axial rod is not required. To form the sintered-powder structure 131, powder to be sintered is disposed inside of the tubular member 10. The tubular member 10 is laid down with the side at which sintered-powder structure 131 facing downwardly for performing sintering.

By the above processes, a composite wick structure is obtained.

Figure 3:
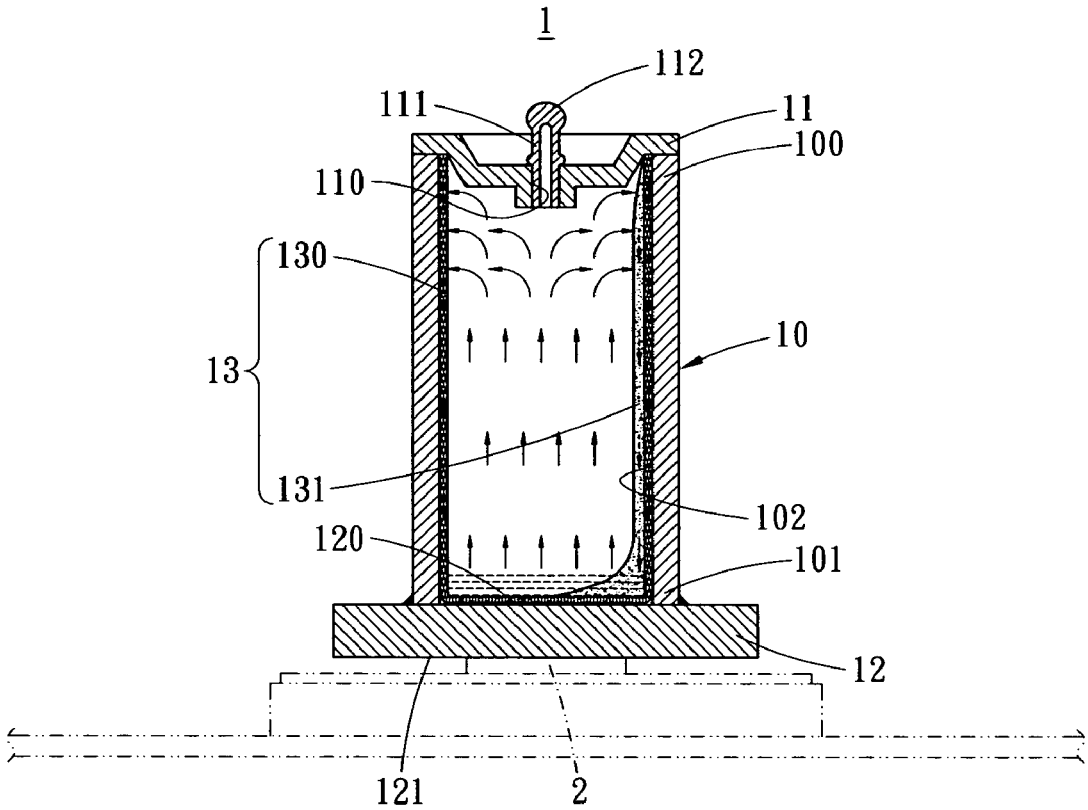
FIG. 3 shows a cross sectional view of the heat pipe in operation.

FIG. 3 shows a cross sectional of the heat pipe in operation. As shown, the external surface 121 of the bottom lid 12 of the heat pipe 1 is in contact with a heat source 2. When the heat source 2 starts to generate heat, the working fluid in the heat pipe absorbs the heat and is evaporated into a gas. The gas then rises up to the top of the heat pipe 1 is then condensed into a liquid absorbed by the wick structure 13 around the internal sidewall 102 of the tubular member 10. Meanwhile, the sintered-powder structure 131 has the better capillary effect to instantly reflow the work fluid back to the bottom of the heat pipe 1. When the bottom of the heat pipe 1 is placed at the lowest level, the gravitation further assists the reflow of the working fluid. Referring to FIG. 2, a portion of the working fluid retained in the woven mesh 130 reflows to the bottom of the heat pipe 1, while the other portion of the working fluid flows towards the sintered-powder structure 131. Thereby, the reflow speed of the working fluid is greatly increased to enhance the heat transmission efficiency.

The internal surface 120 of the bottom lid 12 allows the woven mesh 130 attached thereto. Preferably, the sintered-powder structure 131 extends on the internal surface 120 of the bottom lid 12. Therefore, the reflow of the working fluid back to the bottom of the heat pipe 1 is more fluent. An improved heat circulation is thus operated in the tubular member 10 of the heat pipe 1.

The composite wick structure eliminates the requirement of the axial rod. In addition, a better capillary force is obtained, such that reflow speed of the working fluid is increased. Thereby, the heat conduction performance of the heat pipe is greatly enhanced.

This disclosure provides exemplary embodiments of wick structure of a heat pipe. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed is:

1. A composite wick structure to be attached to an internal sidewall of a hollow tubular member having two opposing ends covering with two lids, comprising a mesh covering over the internal sidewall of the tubular member and an internal surface of one of the lids, and a sintered-powder structure coated on a portion of the mesh of the internal sidewall and the internal surface of the lid.

2. The composite wick structure of claim 1, wherein the sintered-powder structure extending along an elongate direction of the tubular member.

3. A heat pipe, comprising:

a tubular hollow member having an internal sidewall, a top open end and a bottom open end;

a top lid covering the top open end and a bottom lid covering the bottom open end of the tubular member, where the bottom lid having an internal surface and a planner external surface for contacting a heat source;

a mesh covering the internal sidewall of the tubular member and the internal surface of the bottom lid; and a sintered-powder structure coated on a portion of the mesh of the internal sidewall that the coating is extended to a portion of the mesh where covers the internal surface of the bottom lid.

4. The heat pipe of claim 3, further comprising a filling tube extending through the top lid into the tubular member.

5. The heat pipe of claim 3, further comprising a working fluid introduced into the tubular member through the filling tube.

6. The heat pipe of claim 3, wherein the tubular member includes a working fluid therein.

7. The heat pipe of claim 3, wherein the sintered-powder structure extends between the top end and the bottom end.

* * * * *